US006698411B2

(12) United States Patent
Maekawa et al.

(10) Patent No.: US 6,698,411 B2
(45) Date of Patent: Mar. 2, 2004

(54) IGNITION DEVICE FOR INTERNAL COMBUSTION ENGINE

(75) Inventors: Takeo Maekawa, Okazaki (JP); Tetsuya Miwa, Nagoya (JP); Hiromi Hiramatsu, Kariya (JP)

(73) Assignee: Denso Corporation, Kariya-city (JP)

( * ) Notice: Subject to any disclaimer, the term of this patent is extended or adjusted under 35 U.S.C. 154(b) by 0 days.

(21) Appl. No.: 10/402,986

(22) Filed: Apr. 1, 2003

(65) Prior Publication Data

US 2003/0183218 A1 Oct. 2, 2003

(30) Foreign Application Priority Data

Apr. 1, 2002 (JP) ..... 2002-098509
Apr. 1, 2002 (JP) ..... 2002-098511

(51) Int. Cl.[7] ..... F02P 13/00
(52) U.S. Cl. ..... 123/635; 123/634
(58) Field of Search ..... 123/634, 635

(56) References Cited

U.S. PATENT DOCUMENTS 4,715,337 A * 12/1987 Bohl et al. ..... 123/635
6,119,667 A 9/2000 Boyer et al.
2003/0070664 A1 * 4/2003 Skinner et al. ..... 123/634
2003/0070665 A1 * 4/2003 Paul et al. ..... 123/635
2003/0127080 A1 * 7/2003 Sexton ..... 123/634

FOREIGN PATENT DOCUMENTS

| | | |
|---|---|---|
| EP | 0907019 | 4/1999 |
| EP | 0987435 | 3/2000 |
| JP | 2000-91057 | 3/2000 |
| JP | 2000-252040 | 9/2000 |
| JP | 2000-277232 | 10/2000 |

* cited by examiner

*Primary Examiner*—Erick Solis
(74) *Attorney, Agent, or Firm*—Nixon & Vandherye P.C.

(57) ABSTRACT

In an ignition device for use in an internal combustion engine in which a spark plug and an ignition coil are integrated with each other and mounted in a cylinder head, a case is made of an electrical conductive material and one end portion of a secondary winding of the ignition coil is electrically connected to a center electrode of the spark plug while the other end portion of the secondary winding and an earth electrode of the spark plug are electrically connected to the case. Thus, the low-voltage side of the secondary winding and the earth electrode are electrically connected to each other through the case. This eliminates the need for a connector terminal and a wire harness for the electrical connection of the low-voltage side of the secondary winding to the internal combustion engine.

5 Claims, 5 Drawing Sheets

IGNITION DEVICE FOR INTERNAL COMBUSTION ENGINE

BACKGROUND OF THE INVENTION

1) Field of the Invention

The present invention relates to an ignition device for use in an internal combustion engine, which has an integral construction of a spark plug and an ignition coil.

2) Description of the Related Art

So far, as ignition devices for use in internal combustion engines which are constructed in a manner such that an ignition coil and a spark plug are integrated or united with each other, there have been proposed various types (see Japanese Patent Laid-Open No. 2000-252040 and European Patent Laid-Open No. 0907019). Moreover, Japanese Patent Laid-Open No. 2000-277232 discloses a construction in which a pressure detecting element, designed to detect a pressure of a combustion chamber, is incorporated into an ignition device for an internal combustion engine including an ignition coil and a spark plug which are in an integrated condition.

In general, in such types of ignition devices, a low-voltage side of a secondary winding is electrically connected through a connector terminal, an external wire harness and an internal combustion engine to an earth electrode of a spark plug in a manner such that the low-voltage side of the secondary winding is connected to the connector terminal and the wire harness connected to the connector terminal is connected to the internal combustion engine.

This requires one connector terminal and one wire harness for the connection of the low-voltage side of the secondary winding to the internal combustion engine.

In addition, in general, in such types of ignition devices, ignition coil components such as a primary winding, a secondary winding, a center core and an outer-circumferential core are accommodated in a resin-made case for the ignition coil, and spark plug components such as an insulator and a center electrode are accommodated in a metal-made case for the ignition plug.

However, because of the employment of the resin-made type as the case for accommodating the ignition coil components as mentioned above, this requires an outer-circumferential core which is for constituting a magnetic path for a magnetic flux generated by energizing the primary winding of the ignition coil.

SUMMARY OF THE INVENTION

The present invention has been developed with a view to eliminating these disadvantages of the ignition devices, and it is therefore an object of the invention to, in an ignition device for use in an internal combustion engine in which a spark plug and an ignition coil are integrated with each other and mounted in a cylinder head, reduce the number of parts to be put to use therein, that is, eliminating the need for the employment of a connector terminal and a wire harness which are to be used for the electrical connection of a low-voltage side of a secondary winding to the internal combustion engine and the need for the employment of an outer-circumferential core, thus fulfilling the diameter reduction requirement, cost reduction requirement or the like on the ignition device.

For this purpose, a first aspect of the present invention provides an ignition device for an internal combustion engine, comprising a spark plug (2) made to carry out an electric discharge between an center electrode (22) and an earth electrode (23) and an ignition coil (3) having a primary winding (31) and a secondary winding (32) for supplying a high voltage to the spark plug (2), with the spark plug (2) and the ignition coil (3) being mounted in a cylinder head of the internal combustion engine, the ignition device further comprising a tube-like case (1) having a section for accommodating the spark plug (2) and a section for accommodating the ignition coil (3), with the spark plug accommodating section and the ignition coil accommodating section being formed to be integrated with each other, and the case (1) being made of an electrical conductive material and one end portion of the secondary winding (32) and the earth electrode (23) being electrically connected to the case (1).

With this structure, a low-voltage side of the secondary winding and the earth electrode are electrically connected to each other through the case, which eliminates the need for a connector terminal and a wire harness to be used for connecting the low-voltage side of the secondary winding and the internal combustion engine. This enables the size reduction of the connector and enhances the reliability because of eliminating the need for the wriggling location of a wire harness for the electrical connection of the low-voltage side of the secondary winding to the internal combustion engine.

Moreover, this shortens the distance between the low-voltage side of the secondary winding and the earth electrode and reduces the number of connection places, thus reducing the resistance loss in the discharge circuit to enable efficient ignition.

In addition, in the ignition device according to the first aspect of the present invention, a pressure detecting element (4) is provided to detect the pressure in the combustion chamber of the internal combustion engine, and the pressure detecting element (4) is put in the case (1) and is electrically connected thereto and the case (1) is electrically connected to the cylinder head.

With this structure, one end portion (ground side) of the pressure detecting element is electrically connected through the case to the internal combustion engine, which eliminates the need for a connector terminal and a wire harness to be used for electrically connecting the one end portion (ground side) of the pressure detecting element to the internal combustion engine.

Furthermore, for achieving the above-mentioned purpose, a second aspect of the present invention provides an ignition device for an internal combustion engine comprising a spark plug (2) made to carry out an electric discharge in a combustion chamber of the internal combustion engine and an ignition coil (3) having a primary winding (31) and a secondary winding (32) for supplying a high voltage to the spark plug (2), with the spark plug (2) and the ignition coil (3) being mounted in a cylinder head of the internal combustion engine and a center electrode (22) being internally placed in a tube-like insulator (5), and further comprising a tube-like case (1) having a section for accommodating components of the spark plug (2) and a section for accommodating components of the ignition coil (3), with the spark plug component accommodating section and the ignition coil component accommodating section being formed to be integrated with each other, and the case (1) being made of a magnetic and electrical conductive metallic material.

With this structure, the case itself can function as an outer-circumferential core of the ignition coil, which eliminates the need for the separate employment of an outer-circumferential core unlike the conventional art, thus contributing greatly to the size reduction and cost reduction of the ignition device.

Moreover, since the case, including the ignition coil component accommodating section, is integrally formed through the use of the metallic material, the heat radiation property of the ignition coil components is further improvable, as compared with a type in which the ignition coil components are accommodated in a resin-made case.

In addition, in the ignition device according to the second aspect of the present invention, the ignition coil (3) includes a bar-like center core (33) and a slit (15) extending in an axial direction of the center core (33) is made in a section surrounding the center core (33) in the case (1).

This avoids a loss stemming from a ring current generated by a variation of magnetic flux.

Still additionally, in the ignition device according to the second aspect of the present invention, the case (1) is electrically connected to the cylinder head.

In this case, since the ignition coil section is covered with the metal-made case connected to the cylinder head serving as the ground, ignition noises developing in the ignition coil become hard to leak to the external owing to this shielding function of the case.

The reference numerals in parentheses for the above-mentioned means respectively indicate the corresponding relations to the concrete means in embodiments which will be described later.

BRIEF DESCRIPTION OF THE DRAWINGS

Other objects and features of the present invention will become more readily apparent from the following detailed description of the preferred embodiments taken in conjunction with the accompanying drawings in which.

DESCRIPTION OF THE PREFERRED EMBODIMENTS

Embodiments of the present invention will be described hereinbelow with reference to the drawings.

(First Embodiment)

Figure 1:
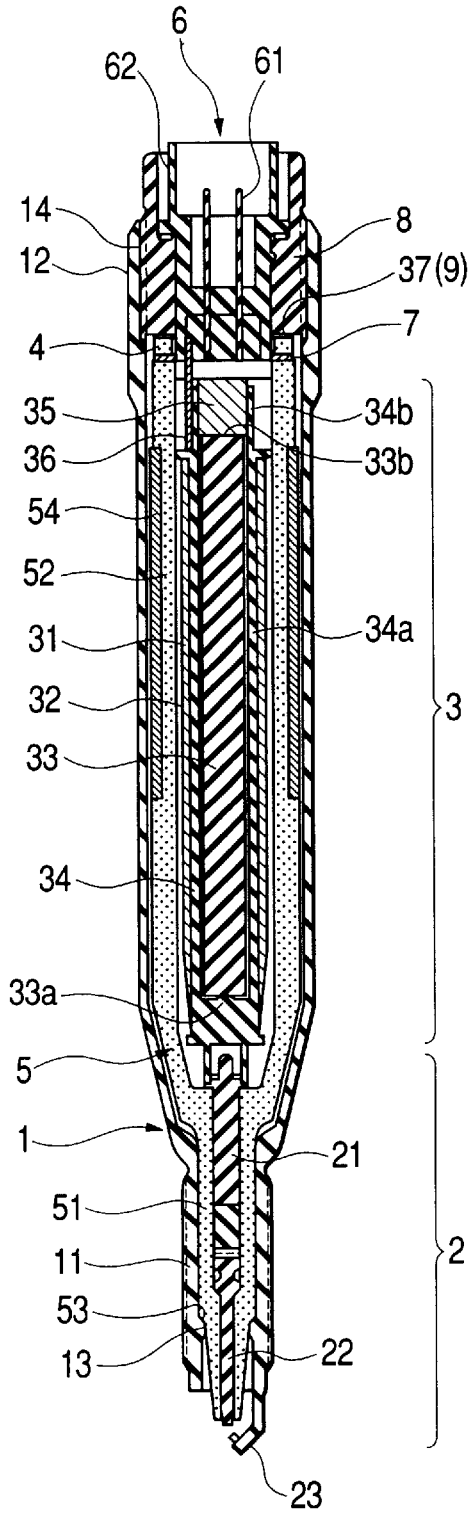
FIG. 1 is a cross-sectional view showing an ignition device according to a first or third embodiment of the present invention.
Figure 2:
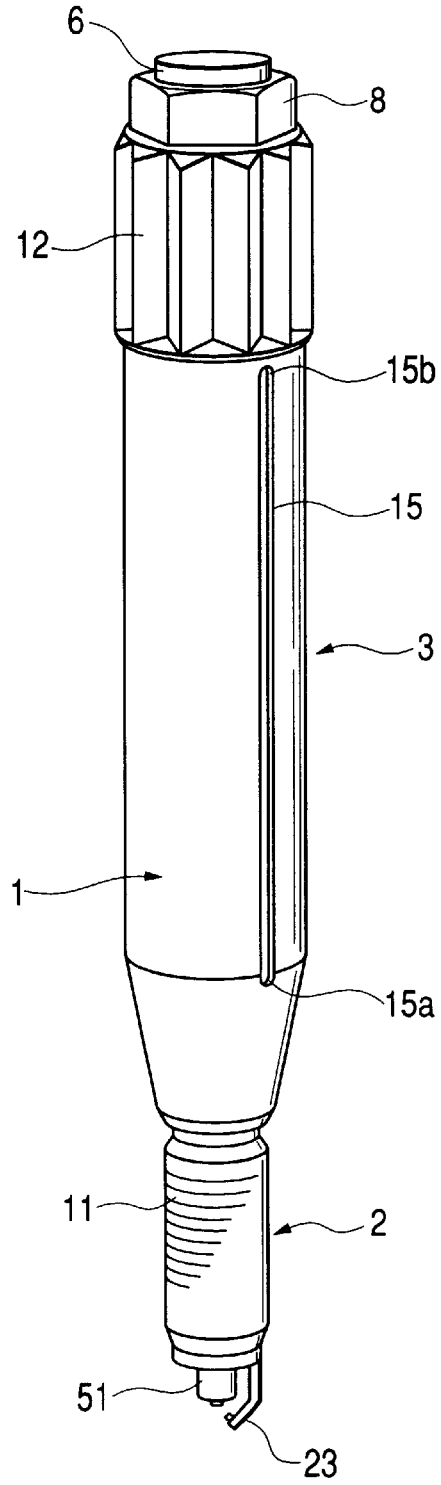
FIG. 2 is a perspective view showing an external appearance of the ignition device according to the present invention.
Figure 3:
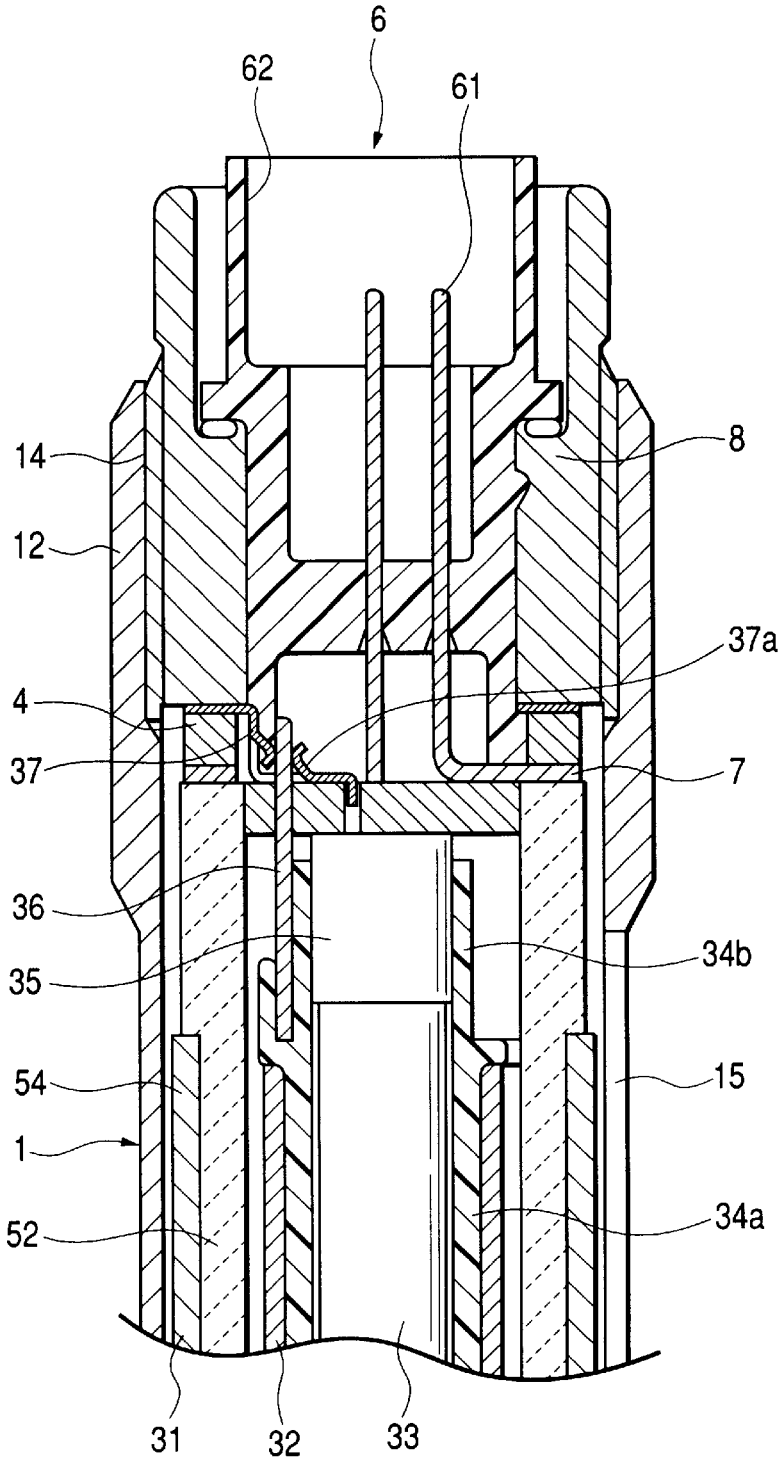
FIG. 3 is an enlarged cross-sectional view showing an essential part of the ignition device shown in FIG. 1.

FIGS. 1 to 3 are illustrations of an ignition device for use in an internal combustion engine according to a first embodiment of the present invention. Of these, FIG. 1 is a cross-sectional view showing the entire construction of the ignition device, FIG. 2 is a perspective view showing an external appearance of the entire ignition device, and FIG. 3 is an enlarged cross-sectional view showing a section in the vicinity of a pressure detecting element 4 in the ignition device.

In FIGS. 1 to 3, the ignition device, in which a spark plug 2, an ignition coil 3 and a pressure detecting element 4 are accommodated in a cylindrical case 1, is mounted in a plug hole of a cylinder head so that both electrodes (which will be mentioned in detail later) of the spark plug 2 are exposed to a combustion chamber of an internal combustion engine (not shown) of a vehicle.

The case 1 is made of a magnetic and electrical conductive metallic material, in more detail, a steel material such as S35C, and in an outer circumferential surface of the case 1, a male screw portion 11 is formed on its combustion chamber side and a tightening nut portion 12 is formed on its side opposite to the combustion chamber. The ignition device is fixedly secured to the cylinder head in a manner such that the case 1 is rotated through the use of the nut portion 12 so that the male screw portion 11 is engaged with a female screw portion (not shown) of the cylinder head.

The case 1 accommodates a cylindrical insulator 5 made of a high-heat-resisting electrical insulating material such as ceramics, and this insulator 5 is equipped with a plug side tube portion 51 positioned on the combustion chamber side and a coil side tube portion 52 extending from the plug side tube portion 51 toward the side opposite to the combustion chamber.

In an inner circumferential surface of the case 1, a stepped receiving surface 13 is formed in the vicinity of the combustion chamber side, and on an outer circumferential surface of the plug side tube section 51 of the insulator 5, a stepped working (contacting) surface 53 is formed to come into contact with the receiving surface 13. Moreover, in a state where the receiving surface 13 and the working surface 53 are brought into contact with each other, the case 1 and the insulator 5 are positioned in an axial direction and the leakage of the combustion gas from a portion between the case 1 and the insulator 5 is preventable. Incidentally, for the improvement of the sealing property, a washer made of an elastic material may be interposed between the receiving surface 13 and the working surface 53.

The spark plug 2 is composed of a stem 21 made of an electrical conductive metal, a center electrode 22 made of an electrical conductive metal, an earth electrode 23 made of an electrical conductive metal, and others. Moreover, the stem 21 and the center electrode 22 are inserted into a central hole of the plug side tube section 51 of the insulator 5, with one end portion of the center electrode 22 being exposed to the combustion chamber. Still moreover, the earth electrode 23 is integrated with the case 1 by means of welding or the like, and the earth electrode 23 is in opposed relation to the one end portion of the center electrode 22.

The ignition coil 3 is composed of a primary winding 31, a secondary winding 32, a rod-like center core 33 made of a magnetic material, a secondary spool 34 made of an electrical insulating resin and formed to have a blind-end type cylindrical configuration, and others.

The primary winding 31 is directly wound around a recess portion 54 of the coil side tube section 52 of the insulator 5. Moreover, both end portions of the primary winding 31 are connected through terminals (not shown) to connector terminals 61 of a connector 6, whereby a control signal is inputted from an igniter (not shown) to the primary winding 31.

Figure 5:
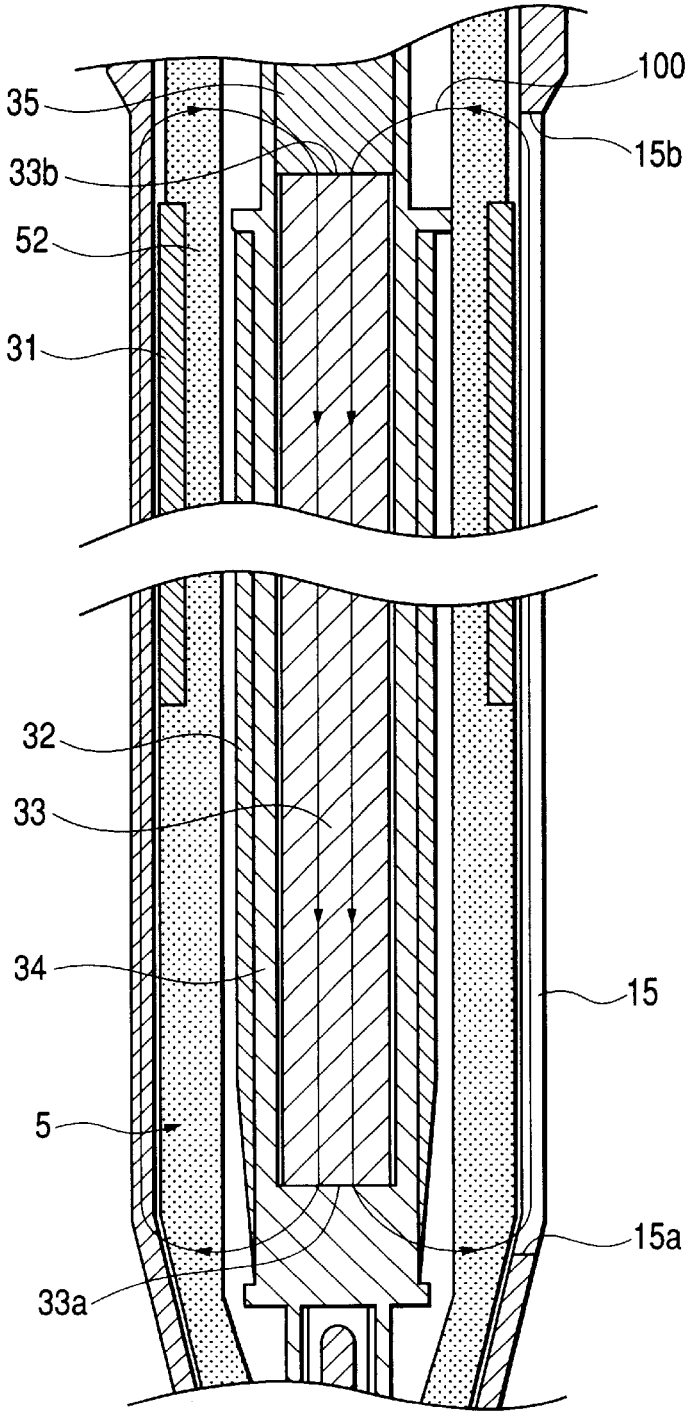
FIG. 5 is an enlarged cross-sectional view showing an essential part of the ignition device shown in FIG. 1, and showing flows of magnetic fluxes generated by energizing a primary winding of an ignition coil.

In the case 1, a section surrounding the center core 33 functions as an outer-circumferential core in which a magnetic flux flows, and as shown in FIG. 5, a magnetic flux 100 generated in the primary winding 31 flows through the center core 33 and the case 1.

In addition, in the case 1, a slit 15 (see FIGS. 2 and 3) extending in an axial direction of the center core 33 is made in the section surrounding the center core 33 in order to avoid a loss stemming from a ring current generated by variation of magnetic flux.

This slit 15 is made to have a length longer than the length of the center core 33. Moreover, a combustion chamber side end portion 15*a* of the slit 15 further extends toward the combustion chamber side with respect to a combustion chamber side end portion 33*a* of the center core 33 and a combustion chamber opposite side end portion 15*b* of the slit 15 further extends toward the side opposite to the combustion chamber with respect to a combustion chamber opposite side end portion 33*b* of the center core 33. In this connection, preferably, the slit 15 has a narrower width, provided that the manufacturing ability permits.

The secondary spool 34 is equipped with a winding tube section 34*a* on which the secondary winding 32 is wound and a protruding tube section 34*b* protruding from the winding tube section 34*a* toward the side opposite to the combustion chamber side. The secondary winding 32 is wound on an outer circumference of the winding tube section 34*a* and the center core 33 is inserted into a central hole of the secondary spool 34. A core pressing cover 35 made of an elastic material such as a rubber or sponge is inserted into an opening of the central hole of the secondary spool 34 to fill up the central hole of the secondary spool 34.

A high-voltage end portion of the secondary winding 32 is electrically connected through the stem 21 of the spark plug 2 to the center electrode 22. On the other hand, a low-voltage end portion of the secondary winding 32 is electrically connected to the case 1 through parts, i.e., a first terminal 36, a second terminal 37 and a bolt 8, placed in the interior of the case 1, and is further electrically connected through the case 1 to the earth electrode 23. In other words, the low-voltage end portion of the secondary winding 32 is electrically connected to the earth electrode 23 without being connected through the internal combustion engine. Moreover, it is brought into contact with the cylinder head through the male screw portion 11 to be connected to the ground.

The first terminal 36 is made of an electrical conductive metal and is formed into a plate-like or bar-like configuration, and is located at a side of the protruding tube section 34*b*, with the low-voltage end portion of the secondary winding 32 being connected to the first terminal 36. The second terminal 37 is made of an electrical conductive metal and includes a sheet ring portion and an insert portion 37*a* protruding inwardly from the ring portion, and the ring portion is located between the pressure detecting element 4 and the bolt 8 and the first terminal 36 is inserted into a hole of the insert portion 37*a*.

The pressure detecting element 4 shows a fluctuation of electric potential in accordance with a variation of a load applied thereto, and is made of, for example, lead titanate and is formed into a sheet ring-like configuration. Moreover, the pressure detecting element 4 is located at an end portion of the coil side tube section 52, with one end portion of the pressure detecting element 4 being electrically connected through the second terminal 37, the bolt 8 and the case 1 to the cylinder head.

In addition, a combustion pressure signal terminal 7 formed into a sheet ring-like configuration is located between the pressure detecting element 4 and an end portion of the coil side tube section 52. This combustion pressure signal terminal 7 is integrated with a connector terminal 61 (see FIG. 3). Thus, an output signal of the pressure detecting element 4 is fed to a control unit (not shown).

In this connection, for allowing the pressure detecting element 4 to be located at the end portion of the coil side tube section 52, the end portion of the coil side tube section 52 is made to extend upwardly with respect to the primary winding 31 and the secondary winding 32 on the paper surface of FIG. 1. In other words, the end portion of the coil side tube section 52 is made to protrude toward the side opposite to the combustion chamber with respect to the primary winding 31 and the secondary winding 32.

The bolt 8 is made of an electrical conductive metal and is formed into a tube-like configuration. The bolt 8 is screw-engaged with the female screw portion 14 made in the case 1 on the side opposite to the combustion chamber so that the second terminal 37, the pressure detecting element 4 and the combustion pressure signal terminal 7 are held between the end portion of the coil side tube section 52 and the bolt 8.

By tightening the bolt 8, a compression preload is applied to the pressure detecting element 4. In addition, this prevents the leakage of the combustion gas from between the case 1 and the insulator 5 owing to the contact between the receiving surface 13 of the case 1 and the working surface 53 of the insulator 5.

After the bolt 8 is screw-engaged with the female screw portion 14, a resin-made case 62 of the connector 6 is inserted into a hollow of the bolt 8.

In the ignition device constructed as mentioned above, in response to a control signal from an igniter, the ignition coil 3 develops a high voltage, and the spark plug 2 discharges the high voltage in a spark gap to ignite an air-fuel mixture in the interior of the combustion chamber. Moreover, the pressure generated by the combustion in the combustion chamber is transmitted through the insulator 5 to the pressure detecting element 4 so that the pressure detecting element 4 receives a compression load. The pressure detecting element 4 outputs a voltage signal corresponding to this load.

In this embodiment, since the low-voltage side of the secondary winding 32 and the earth electrode 23 of the spark plug 2 are electrically connected to each other through the case 1, a connector terminal and a wire harness for the electrical connection of the low-voltage side of the secondary winding 32 to the internal combustion engine becomes unnecessary. This enables the size reduction of the connector 6, and eliminates the need for the wriggling location of the wire harness for the electrical connection of the low-voltage side of the secondary winding 32 to the internal combustion engine, thus enhancing the reliability of the apparatus.

Moreover, this shortens the distance between the low-voltage side of the secondary winding 32 and the earth electrode 23 of the spark plug 3 and reduces the number of connection places, thus reducing the resistance loss in the discharge circuit to provide efficient ignition.

Furthermore, since the one end portion of the pressure detecting element 4 is electrically connected through the case 1 to the internal combustion engine, there is no need to employ a connector terminal and a wire harness for the electrical connection of the one end portion of the pressure detecting element 4 to the internal combustion engine.

Still furthermore, since the end portion of the coil side tube section 52 is made to protrude toward the side opposite to the combustion chamber with respect to the primary winding 31 and the secondary winding 32 so that the pressure detecting element 4 is located at the end portion of the coil side tube section 52, the signal lines of the pressure detecting element 4 can be drawn out to the exterior of the case 1 without passing by the ignition coil 3. This not only avoids an increase in diameter of the case 1 but also enables an output signal of the pressure detecting element 4 to undergo less influence of discharge noises from the ignition coil 3 and even eliminates the need for the wriggling location of the signal lines or facilitates it.

Moreover, since a compression preload is applied to the pressure detecting element 4 by tightening the bolt 8, the output thereof is attainable with high accuracy with respect to the pressure variation in the combustion chamber.

Still moreover, since the working surface 53 of the insulator 5 is pressed against the receiving surface 13 of the case 1 by tightening the bolt 8, the contact portion between the receiving surface 13 and the working surface 53 can prevent the combustion gas from leaking between the case 1 and the insulator 5.

Yet moreover, since the case 1, including the section accommodating the ignition coil components, is formed in an integrated fashion through the use of a metallic material, the heat radiation property of the ignition coil components becomes further improvable, as compared with a type in which the ignition coil components are put in a resin-made case.

In addition, since the case 1 itself can function as an outer-circumferential core of the ignition coil, it is possible to eliminate the need for the separate employment of an outer-circumferential core unlike the conventional art, thus contributing greatly to the size reduction and cost reduction of the ignition device.

Still additionally, the slit 15 is made in the section surrounding the center core 33 in the case 1, which avoids a loss stemming from a ring current generated by variation of magnetic flux.

Yet additionally, since the windings 31 and 32 and others in the ignition coil 3 are covered with the metal-made case 1 connected to the cylinder head serving as the ground, ignition noises developing in the ignition coil 3 become hard to leak to the external owing to this shielding function of the case 1.

(Second Embodiment)

A second embodiment is the application of the present invention to an ignition device for an internal combustion engine which includes no pressure detecting element 4.

Figure 4:
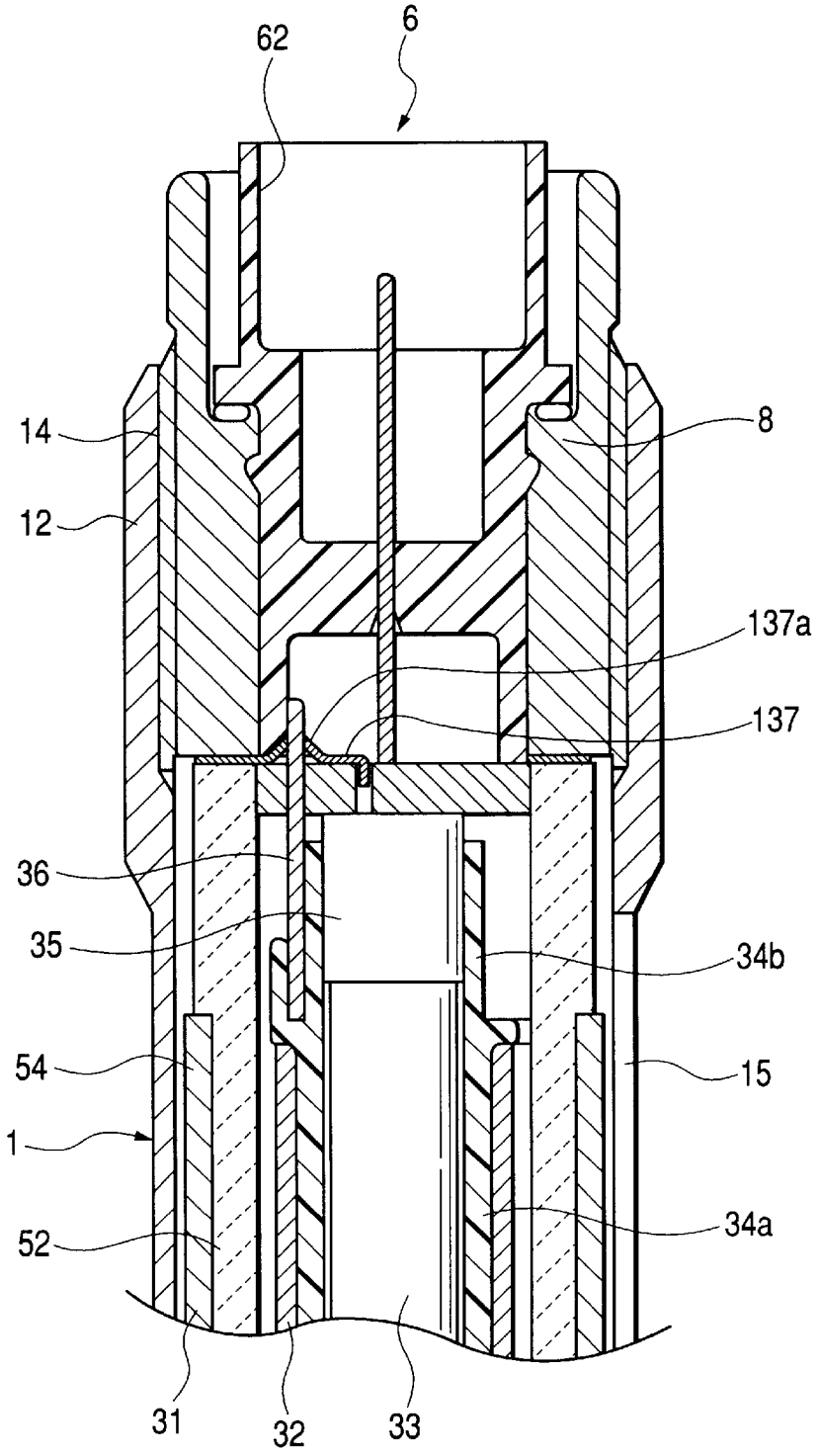
FIG. 4 is a cross-sectional view showing an essential part of an ignition device according to a second embodiment of the present invention.

FIG. 4 is an illustration of an essential part of the ignition device for an internal combustion engine according to this embodiment, where the same components as those in the above-described first embodiment are marked with the same reference numerals, and the description thereof will be omitted for brevity. Moreover, the other components which do not appear in the illustration are the same as those in the first embodiment.

In FIG. 4, a second terminal 137 made of an electrical conductive metal is composed of a sheet ring portion and an insert portion 137*a* protruding inwardly from the ring portion, and the ring portion is located between an end portion of the coil side tube section 52 and the bolt 8 and the first terminal 36 is inserted into a hole of the insert portion 137*a*. Thus, a low-voltage end portion of the secondary winding 32 is electrically connected through the first terminal 36, the second terminal 137 and the bolt 8 to the case 1.

Accordingly, this embodiment also can eliminate the need for a connector terminal and a wire harness for the electrical connection of the low-voltage side of the secondary winding 32 to the internal combustion engine. Moreover, this shortens the distance between the low-voltage side of the secondary winding 32 and the earth electrode 23 of the spark plug 2, and reduces the number of connection places, thus reducing the resistance loss in the discharge circuit to enable efficient ignition.

(Third Embodiment)

A difference of this embodiment from the above-described first embodiment is that in FIG. 1, in place of the second terminal 37, an earth plate 9 is provided so that the low-voltage end portion of the secondary winding 32 is electrically connected through the first terminal 36, the earth plate 9 and the bolt 8 to the case 1 and electrically connected through the case 1 to the earth electrode 23, thereby electrically connecting the low-voltage end portion of the secondary winding 32 to the earth electrode 23 without interposing the internal combustion engine. Moreover, one end portion of the pressure detecting element 4 is electrically connected through the earth plate 9, the bolt 8 and the case 1 to the cylinder head. Still moreover, when the bolt 8 is screw-engaged with the female screw 14, the earth plate 9, the pressure detecting element 4 and the combustion pressure signal terminal 7 are held between the end portion of the coil side tube section 52 and the bolt 8.

This embodiment can provide the same effects as those of the above-described first embodiment. That is, in this embodiment, since the low-voltage side of the secondary winding 32 and the earth electrode 23 of the spark plug 2 are electrically connected to each other through the case 1, a connector terminal and a wire harness for the electrical connection of the low-voltage side of the secondary winding 32 to the internal combustion engine becomes unnecessary. This enables the size reduction of the connector 6, and eliminates the need for the wriggling location of the wire harness for the electrical connection of the low-voltage side of the secondary winding 32 to the internal combustion engine, thus enhancing the reliability of the apparatus.

Moreover, this shortens the distance between the low-voltage side of the secondary winding 32 and the earth electrode 23 of the spark plug 3 and reduces the number of connection places, thus reducing the resistance loss in the discharge circuit to provide efficient ignition.

Furthermore, since the one end portion of the pressure detecting element 4 is electrically connected through the case 1 to the internal combustion engine, there is no need to employ a connector terminal and a wire harness for the electrical connection of the one end portion of the pressure detecting element 4 to the internal combustion engine.

Still furthermore, since the end portion of the coil side tube section 52 is made to protrude toward the side opposite to the combustion chamber with respect to the primary winding 31 and the secondary winding 32 so that the pressure detecting element 4 is located at the end portion of the coil side tube section 52, the signal lines of the pressure detecting element 4 can be drawn out to the exterior of the case 1 without passing by the ignition coil 3. This not only avoids an increase in diameter of the case 1 but also enables an output signal of the pressure detecting element 4 to undergo less influence of discharge noises from the ignition coil 3 and even eliminates the need for the wriggling location of the signal lines or facilitates it.

Moreover, since a compression preload is applied to the pressure detecting element 4 by tightening the bolt 8, the output thereof is attainable with high accuracy with respect to the pressure variation in the combustion chamber.

Still moreover, since the working surface 53 of the insulator 5 is pressed against the receiving surface 13 of the case 1 by tightening the bolt 8, the contact portion between the receiving surface 13 and the working surface 53 can prevent the combustion gas from leaking between the case 1 and the insulator 5.

Yet moreover, since the case 1, including the section accommodating the ignition coil components, is formed in an integrated fashion through the use of a metallic material, the heat radiation property of the ignition coil components becomes further improvable, as compared with a type in which the ignition coil components are put in a resin-made case.

In addition, since the case 1 itself can function as an outer-circumferential core of the ignition coil, it is possible to eliminate the need for the separate employment of an outer-circumferential core unlike the conventional art, thus contributing greatly to the size reduction and cost reduction of the ignition device.

Still additionally, the slit 15 is made in the section surrounding the center core 33 in the case 1, which avoids a loss stemming from a ring current generated by variation of magnetic flux.

Yet additionally, since the windings 31 and 32 and others in the ignition coil 3 are covered with the metal-made case 1 connected to the cylinder head serving as the ground, ignition noises developing in the ignition coil 3 become hard to leak to the external owing to this shielding function of the case 1.

(Other Embodiments)

Although in the above-described embodiments the secondary winding 32 is located on the inner circumferential side while the primary winding 31 is located on the outer circumferential side, the present invention is not limited to this, but it is also acceptable that the secondary winding 32 is put on the outer circumferential side while the primary winding 31 is put on the inner circumferential side.

In addition, although in the above-described embodiments a preload is applied to the pressure detecting element 4 by tightening the bolt 8, it is also possible that a holding member having no screw structure is used in place of the bolt 8 so that the holding member is put in the case 1 under pressure, or the case 1 is caulked after the holding member is inserted thereinto, for applying a preload to the pressure detecting element 4. Yet additionally, it is also acceptable that, after the holding member is inserted into the case 1, the holding member is welded with the case 1 in a state where a preload is given to the pressure detecting element 4.

Moreover, it is also possible that the case 1 is prepared in a divided condition and the divisions are integrated with each other by means of welding or the like. In more detail, for example, a section accommodating the components of the spark plug 2 and a section accommodating the components of the ignition coil 3 are formed separately and then integrated with each other through welding or the like.

It should be understood that the present invention is not limited to the above-described embodiments, and that it is intended to cover all changes and modifications of the embodiments of the invention herein which do not constitute departures from the spirit and scope of the invention.

What is claimed is:

1. An ignition device for an internal combustion engine, comprising:

a spark plug made to carry out electric discharge between an center electrode and an earth electrode;

an ignition coil having a primary winding and a secondary winding for supplying a high voltage to said spark plug, with said spark plug and said ignition coil being mounted in a cylinder head of said internal combustion engine;

a tube-like case having a section for accommodating components of said spark plug and a section for accommodating components of said ignition coil, with said spark plug component accommodating section and said ignition coil component accommodating section being formed to be integrated with each other and said case being made of an electrical conductive material and one end portion of said secondary winding and said earth electrode being electrically connected to said case.

2. The device according to claim 1, further comprising a pressure detecting element for detecting a pressure in a combustion chamber of said internal combustion engine, said pressure detecting element being put in said case and being electrically connected to said case and said case being electrically connected to said cylinder head.

3. An ignition device for an internal combustion engine comprising:

a spark plug made to carry out electric discharge in a combustion chamber of said internal combustion engine;

an ignition coil having a primary winding and a secondary winding for supplying a high voltage to said spark plug, with said spark plug and said ignition coil being mounted in a cylinder head of said internal combustion engine and a center electrode of said spark plug being internally placed in a tube-like insulator; and a tube-like case having a section for accommodating components of said spark plug and a section for accommodating components of said ignition coil, with said spark plug component accommodating section and said ignition coil component accommodating section being formed to be integrated with each other, and said case being made of a magnetic and electrical conductive metallic material.

4. The device according to claim 3, wherein said ignition coil includes a bar-like center core, and a slit extending in an axial direction of said center core is made in a section surrounding said center core in said case.

5. The device according to claim 3, wherein said case is electrically connected to said cylinder head.

* * * * *